US009595779B2

(12) United States Patent
Nakamura et al.

(10) Patent No.: US 9,595,779 B2
(45) Date of Patent: Mar. 14, 2017

(54) ELECTRICAL CONNECTOR HAVING A PROVISIONAL FIXING MEMBER WITH A PLURALITY OF PROVISIONAL FIXING PORTIONS

(71) Applicant: Japan Aviation Electronics Industry, Limited, Tokyo (JP)

(72) Inventors: Keisuke Nakamura, Tokyo (JP); Osamu Hashiguchi, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days.

(21) Appl. No.: 15/041,702

(22) Filed: Feb. 11, 2016

(65) Prior Publication Data

US 2016/0164207 A1 Jun. 9, 2016

Related U.S. Application Data

(62) Division of application No. 14/543,392, filed on Nov. 17, 2014, now Pat. No. 9,306,305.

(30) Foreign Application Priority Data

Dec. 24, 2013 (JP) ..... 2013-265881

(51) Int. Cl.
*H01R 11/22* (2006.01)
*H01R 12/72* (2011.01)
(Continued)

(52) U.S. Cl.
CPC ..... *H01R 12/721* (2013.01); *H01R 12/7082* (2013.01); *H01R 12/79* (2013.01); *H01R 12/88* (2013.01); *H01R 23/684* (2013.01)

(58) Field of Classification Search
CPC .. H01R 12/721; H01R 12/7082; H01R 23/68; H01R 23/6806; H01R 23/6813; H01R 23/682; H01R 23/6826; H01R 23/684
(Continued)

(56) References Cited

U.S. PATENT DOCUMENTS 6,431,897 B1 * 8/2002 Hashiguchi ..... H01R 12/79 439/267
7,275,954 B2 10/2007 Ikenaga
(Continued)

FOREIGN PATENT DOCUMENTS

CN 1992440 7/2007
CN 102195159 9/2011
(Continued)

*Primary Examiner* — Chandrika Prasad
(74) *Attorney, Agent, or Firm* — Muncy, Geissler, Olds & Lowe, P.C.

(57) ABSTRACT

An electrical connector includes a plurality of contacts, each contact having a first contact point electrically connected to a wiring pattern of a first connection object at one end and a second contact point mounted and fixed onto a wiring pattern of a second connection object by soldering at the other end, and the plurality of contacts is arranged in accordance with a predetermined wiring pattern, and after the second contact is mounted and fixed onto the wiring pattern of the second connection object, portions other than the second contact point of each contact are not fixed and bound with respect to the second connection object.

10 Claims, 14 Drawing Sheets

(51) Int. Cl.
*H01R 12/50* (2011.01)
*H01R 12/79* (2011.01)
*H01R 12/88* (2011.01)
*H01R 12/70* (2011.01)

(58) Field of Classification Search
USPC ..... 439/259–261, 267
See application file for complete search history.

(56) References Cited

U.S. PATENT DOCUMENTS 7,361,042 B2 * 4/2008 Hashimoto ..... H01R 12/88 439/260
7,524,204 B2 * 4/2009 Shimada ..... H01R 12/79 439/260
7,581,973 B2 9/2009 Fukazawa
7,601,017 B2 * 10/2009 Wang ..... H01R 12/79 439/260
7,766,680 B2 8/2010 Suzuki
7,833,035 B2 * 11/2010 Lin ..... H01R 12/88 439/260
8,218,425 B2 7/2012 Laroia
8,398,417 B2 3/2013 Ozeki
8,651,893 B2 2/2014 Ogura
9,306,305 B2 * 4/2016 Nakamura ..... H01R 23/684
2005/0118849 A1 * 6/2005 Okita ..... H01R 12/88 439/260
2006/0089036 A1 * 4/2006 Takai ..... H01R 12/771 439/260
2006/0286843 A1 * 12/2006 Fukazawa ..... H01R 12/88 439/260
2012/0142223 A1 6/2012 Ogura et al.
2012/0208385 A1 8/2012 Ozeki et al.

FOREIGN PATENT DOCUMENTS

JP 09-204974 A 8/1997
JP 2013-62098 A 4/2013
KR 20130060102 A 6/2013

* cited by examiner

ELECTRICAL CONNECTOR HAVING A PROVISIONAL FIXING MEMBER WITH A PLURALITY OF PROVISIONAL FIXING PORTIONS

CROSS REFERENCE TO RELATED APPLICATIONS

This application is a Divisional of application Ser. No. 14/543,392, filed on Nov. 17, 2014, and for which priority is claimed under 35 U.S.C. §120; and this application claims priority of Application No. 2013-265881 filed in Japan on Dec. 24, 2013 under 35 U.S.C. §119; the entire contents of all of which are hereby incorporated by reference.

BACKGROUND OF THE INVENTION

The present invention relates to an electrical connector, and in particular, to an electrical connector which connects a first connection object and a second connection object each having a predetermined wiring pattern.

In this kind of electrical connector, in general, electrical connection of the first connection object and the second connection object is performed through a plurality of contacts formed and arranged in a connector housing.

For example, JP2013-62098A discloses a connector which, as shown in FIG. 34, has a plurality of contacts 2 fixed in a connector housing 1 and connects connection objects, such as a flexible printed circuit (FPC) and a flexible flat cable (FFC).

Each of the contacts 2 has press-fitting protrusions 3 and 4 and is press-fitted and fixed in the connector housing 1, a contact point portion 5 is formed at the tip of the contact 2, and a mounting portion 7 which is mounted and fixed onto the wiring pattern of a substrate 6 by soldering is formed at the rear end of the contact 2. A connection object insertion portion 8 is formed in the connector housing 1, and the end portion of a connection object is inserted into the connection object insertion portion 8, whereby the wiring pattern disposed on the lower surface of the connection object comes into contact with the contact point portion 5 of the contact 2 and is electrically connected to the wiring pattern of the substrate 6 through the mounting portion 7 of the contact 2.

However, if external force or the like is applied to the substrate 6 on which the connector is mounted and deformation occurs in the substrate 6, since each of the plurality of contacts 2 is press-fitted and fixed in the connector housing 1 through the press-fitting protrusions 3 and 4, stress due to the deformation of the substrate 6 is concentrated on the mounting portion 7 soldered to the wiring pattern of the substrate 6. As a result, the mounting portion 7 of the contact 2 is likely to be damaged.

In particular, recently, with miniaturization and densification of electronic apparatuses, reduction in external dimension has been required for a connector, and thus, a small and thin contact has been used as the contact 2. For this reason, when deformation, such as warping, strain, or bending, occurs in the substrate 6, there is a problem in that the mounting portion 7 of the contact 2 is likely to be damaged.

SUMMARY OF THE INVENTION

The invention has been accomplished in order to solve the above-mentioned problem in the prior art, and an object of the invention is to provide an electrical connector capable of reducing a concern that a mounting portion of a contact is damaged, even if deformation occurs in a substrate on which the electrical connector is mounted.

The present invention provides an electrical connector which connects a first connection object and a second connection object each having a predetermined wiring pattern, the electrical connector comprising a plurality of contacts, each contact having a first contact point, which is electrically connected to the wiring pattern of the first connection object, at one end and a second contact point, which is to be mounted and fixed onto the wiring pattern of the second connection object by soldering, at the other end, wherein the plurality of contacts is arranged in accordance with the predetermined wiring pattern, and after the second contact point is mounted and fixed onto the wiring pattern of the second connection object, portions other than the second contact point of each of the contacts are not fixed and bound with respect to the second connection object.

BRIEF DESCRIPTION OF THE DRAWINGS

FIG. 1A is a plan view and a FIG. 1B is a rear view.

FIG. 11A is a plan view and FIG. 11B is a rear view.

FIG. 12A is an overall perspective view, FIG. 12B is a partial enlarged perspective view, FIG. 12C is a partial plan view, FIG. 12D is a partial front view, FIG. 12E is a partial bottom view, FIG. 12F is a side view, and FIG. 12G is a sectional view taken along the line B-B of FIG. 12D.

FIG. 15A is a plan view and FIG. 15B is a rear view.

FIG. 16A is an overall perspective view, FIG. 16B is a partial enlarged perspective view, FIG. 16C is a partial plan view, FIG. 16D is a partial front view, FIG. 16E is a partial bottom view, FIG. 16F is a side view, and FIG. 16G is a sectional view taken along the line C-C of FIG. 16D.

FIG. 19A is a plan view and FIG. 19B is a rear view.

FIG. 20A is an overall perspective view, FIG. 20B is a partial enlarged perspective view, FIG. 20C is a partial plan view, FIG. 20D is a partial front view, FIG. 20E is a partial bottom view, FIG. 20F is a side view, and FIG. 20G is a sectional view taken along the line E-E of FIG. 20D.

FIG. 26A is a plan view and FIG. 268 is a rear View.

FIG. 27A is an overall perspective view, FIG. 27B is a partial enlarged perspective view, FIG. 27C is a partial plan view, FIG. 27D is a partial front view, FIG. 27E is a partial bottom view, FIG. 27F is a side view, and FIG. 27G is a sectional view taken along the line G-G of FIG. 27D.

DETAILED DESCRIPTION OF THE INVENTION

Embodiment 1

Hereinafter, Embodiment 1 of the invention will be described based on the accompanying drawings.

Figure 1A:
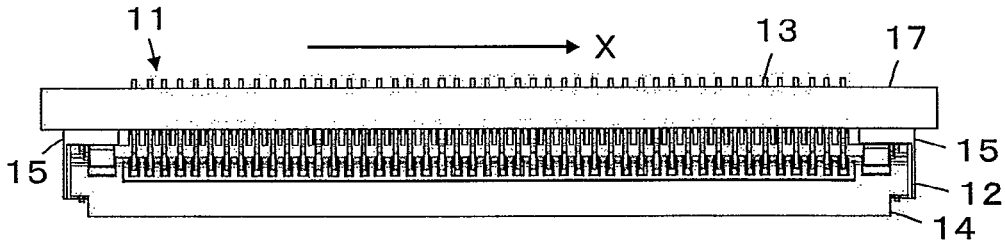
FIGS. 1A and 1B show an electrical connector according to Embodiment 1 of the present invention.

FIGS. 1A and 18B show the configuration of an electrical connector 11 according to Embodiment 1. The electrical connector 11 includes a base member 12 extending in an X direction, a plurality of contacts 13 held by the base member 12, and an actuator 14 rotatably attached to the base member 12.

The base member 12 is formed of an electric insulating material, and has mound portions 15 which are respectively disposed in both end portions in the X direction and have a predetermined height, and a connection portion 16 which extends in the X direction and connects both mound portions 15 with each other.

Further, a provisional contact fixing member 17 for provisionally fixing the plurality of contacts (hereinafter simply referred to as "a provisional contact fixing member") that extends in the X direction is disposed to span both mound portions 15 of the base member 12.

Figure 1B:
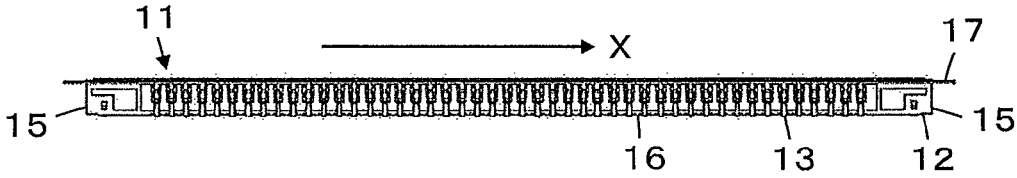

The actuator 14 is rotatable between an open position and a closed position around a rotation axis extending in the X direction, and in FIGS. 1A and 1B, the actuator 14 which is at the closed position is shown. When the actuator 14 is in the state of open position, a connection end of a connection object can be inserted into the electrical connector 11, and when the actuator 14 is in the state of closed position, the connection object can be mechanically held by the electrical connector 11 and electrically connected to the plurality of contacts 13.

Figure 2:
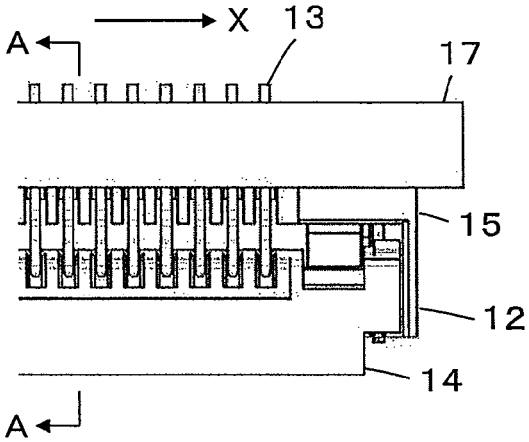
FIG. 2 is a partial enlarged plan view of the electrical connector according to Embodiment 1.

As shown in FIG. 2, the respective contacts of the plurality of contacts 13 are formed of a flat plate-like metallic material extending in a plane perpendicular to the X direction, and are held by the base member 12 in a state of being arranged in the X direction to be parallel with each other.

Figure 3:
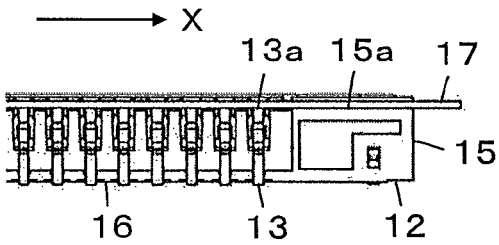
FIG. 3 is a partial enlarged rear view of the electrical connector according to Embodiment 1.

As shown in FIG. 3, the respective contacts 13 have almost the same height as both mound portions 15 of the base member 12, and an upper end surface 13*a* of the contact 13 and an upper end surface 15*a* of each of the mound portions 15 of the base member 12 are substantially flush with each other.

The provisional fixing contact member 17 is composed of an adhesive tape which is formed of polyimide or the like and has a peelable adhesive surface on the lower surface thereof. Both end portions of the provisional contact fixing member 17 are allowed to peelably adhere to the upper end surfaces 15*a* of a pair of mound portions 15 of the base member 12, and the intermediate portion thereof is allowed to peelably adhere to the upper end surfaces 13*a* of the plurality of contacts 13. The provisional contact fixing member 17 is a member for provisionally fixing the respective contacts of the plurality of contacts 13 in a state of being arranged in the X direction and being in parallel with each other.

Figure 4:
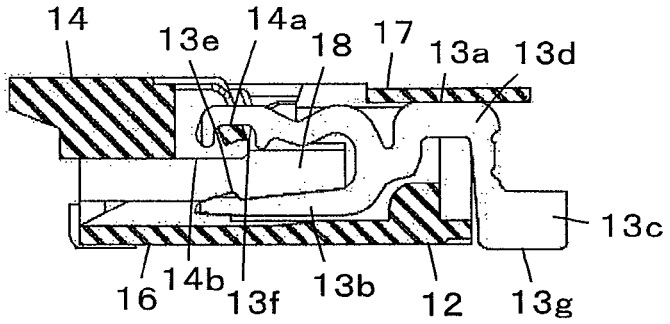
FIG. 4 is a sectional view taken along the line A-A of FIG. 2.

As shown in FIG. 4, each of the contacts 13 has a forked tuning fork-shaped portion 13*b* at the tip and a rectangular mounting portion 13*c* at the rear end, and a curved portion 13*d* which is curved upward in a convex shape is formed between the tuning fork-shaped portion 13*b* and the mounting portion 13*c*. A lower end portion of the tuning fork-shaped portion 13*b* extends along the surface of the connection portion 16 of the base member 12 up to directly under the actuator 14 and forms a first contact point 13*e* which is a spring contact point protruding upward, and an upper end portion of the tuning fork-shaped portion 13*b* extends to face the first contact point 13*e* and forms a concave portion 13*f* which is hooked to a rod-like portion 14*a* formed in the actuator 14. The mounting portion 13*c* protrudes to the rear portion of the connection portion 16 of the base member 12, and a flat second contact point 13*g* is formed in the lower surface of the mounting portion 13*c*. Further, the flat upper end surface 13*a* is formed in the upper surface of the curved portion 13*d*, and the lower surface of the provisional contact fixing member 17 is allowed to peelably adhere to the upper end surface 13*a*.

An insertion portion 18 which is a space for inserting the connection end of a sheet-like or flat plate-like connection object, such as an FPC and an FFC, is formed in the connection portion 16 of the base member 12.

A pressing portion 14*b* having a cam structure is formed in the actuator 14 rotatably attached to the base member 12.

Figure 5:
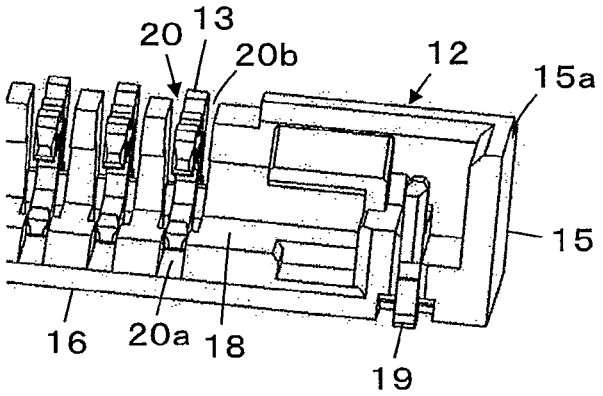
FIG. 5 is a partial perspective view showing a base member and a contact which are used in the electrical connector according to Embodiment 1.

As shown in FIG. 5, a fixing and reinforcing metal attachment 19 for mounting and fixing the base member 12 onto a substrate as a second connection object by soldering is fixed to each mound portion 15 of the base member 12.

A plurality of reception grooves 20 which respectively receive the plurality of contacts 13 are formed and arranged in the connection portion 16 of the base member 12. Each of the reception grooves 20 is composed of a first groove portion 20*a* which receives the periphery of the first contact point 13*e* formed at the tip of the corresponding contact 13 and a second groove portion 20*b* which receives the second contact point 13*g* side rather than the first contact point 13*e*, specifically the root portion of the tuning fork-shaped portion 13*b* and the curved portion 13*d*.

Figure 6:
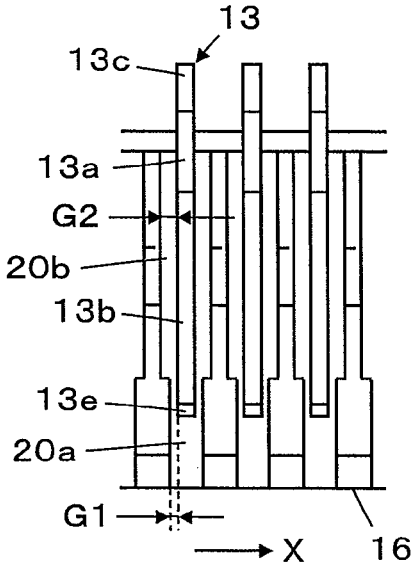
FIG. 6 is a plan view schematically showing a state where the contacts are received in reception grooves formed in the base member of the electrical connector according to Embodiment 1.

As shown in FIG. 6, in the first groove portion 20*a*, a very small first clearance G1 is formed on each side of the contact 13 received, and in the second groove portion 20*b*, a second clearance G2 greater than the first clearance G1 is formed on each side of the contact 13 received. This is because the first contact point 13*e* side of the contact 13 is positioned in the X direction which is the arrangement direction of the plurality of contacts 13, but on the other hand, the second contact 13*g* side of the contact 13 is not fixed and bound in the X direction.

In this way, the plurality of contacts 13 are arranged on the connection portion 16 of the base member 12 in a state of being received in the plurality of reception grooves 20, each of which is formed wider than the width of the contact 13 in the X direction which is the arrangement direction. Then, the intermediate portion of the provisional contact fixing member 17 is allowed to peelably adhere to the upper end surface 13*a* of each of the plurality of contacts 13, and both end portions of the provisional contact fixing member 17 are respectively allowed to peelably adhere to the corresponding upper end surfaces 15*a* of the mound portions 15 of the base member 12, whereby the position of the provisional contact fixing member 17 with respect to the base member 12 is fixed, and also the position in the X direction of the upper end surface 13*a* of each of the plurality of contacts 13 is provisionally fixed through the provisional contact fixing member 17.

Figure 7:
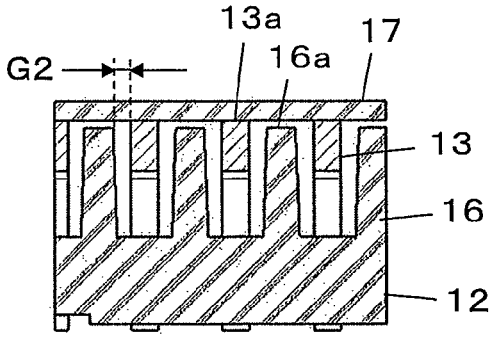
FIG. 7 is a sectional front view schematically showing a state where the contacts are received in the reception grooves formed in the base member of the electrical connector according to Embodiment 1.

As this time, as shown in FIG. 7, upper surfaces 16*a* of the connection portion 16 of the base member 12 below the provisional contact fixing member 17 are lower in height than the upper end surfaces 13*a* of the contacts 13. Therefore, the provisional contact fixing member 17 is allowed to adhere to the upper end surface 13*a* of each of the contacts 13 without being allowed to adhere to the connection portion 16 of the base member 12, and holds the contacts 13 such that the second clearances G2 are formed between each contact 13 and the connection portion 16.

Figure 8:
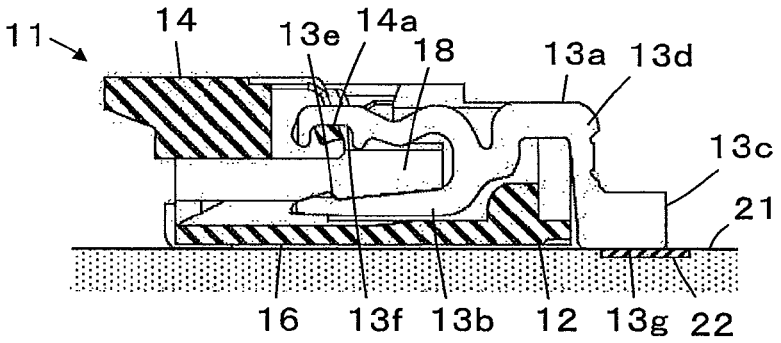
FIG. 8 is a sectional side view showing the electrical connector of Embodiment 1 in which a second contact point of the contact is mounted and fixed onto a wiring pattern of a second connection object.

As shown in FIG. 8, the electrical connector 11 configured as above is mounted on the surface of a circuit board 21 (second connection object) and used. A plurality of wiring patterns 22 corresponding to the mounting portions 13*c* of the plurality of contacts 13 of the electrical connector 11 is arranged on the surface of the circuit board 21, and the second contact point 13*g* of the mounting portion 13*c* of each contact 13 is soldered to the corresponding wiring patterns 22. In addition, on the surface of the circuit board 21, mounting pads (not shown) are formed corresponding to the fixing and reinforcing metal attachments 19 respectively disposed on the mound portions 15 of the base member 12 of the electrical connector 11, and the fixing and reinforcing metal attachments 19 are soldered to the mounting pads, whereby the base member 12 is fixed to the circuit board 21. With this, the electrical connector 11 is mounted on the surface of the circuit board 21.

Soldering of the second contact points 13*g* of the plurality of contacts 13 and soldering of the fixing and reinforcing metal attachments 19 can be performed simultaneously by a reflow method.

While the second contact point 13*g* side of each contact 13, specifically, the root portion of the tuning fork-shaped portion 13*b* and the curved portion 13*d* are received in the second groove portion 20*b* of the reception groove 20 of the connection portion 16 such that the second clearances G2 greater than the first clearances G1 on the first contact 13*e* side are formed, the upper end surface 13*a* of the contact 13 is bonded to the provisional contact fixing member 17, whereby the position in the X direction is fixed. Accordingly, the second contact point 13*g* of each of the plurality of contacts 13 can be accurately soldered to the corresponding wiring pattern 22 of the circuit board 21, and after soldering is completed, the provisional contact fixing member 17 is no longer required and is thus removed.

After the electrical connector 11 is mounted on the surface of the circuit board 21 as described above, as shown in FIG. 9, the provisional contact fixing member 17 is peeled and removed from the upper end surface 13*a* of each of the plurality of contacts 13 and the upper end surface 15*a* of each of the mound portions 15 of the base member 12. Therefore, each contact 13 is in a state where the second contact 13*g* at the rear end is soldered and fixed to the corresponding wiring pattern 22 of the circuit board 21, but portions other than the second contact point 13*g* is not fixed and bound to the circuit board 21. While the first contact point 13*e* at the tip of the contact 13 is received in the first groove portion 20*a* of the reception groove 20 of the connection portion 16, the first clearances G1 are formed between the contact 13 and the first groove portion 20*a*, and thus, the first contact point 13*e* is in a state where it can freely move without being fixed and bound.

Figure 9:
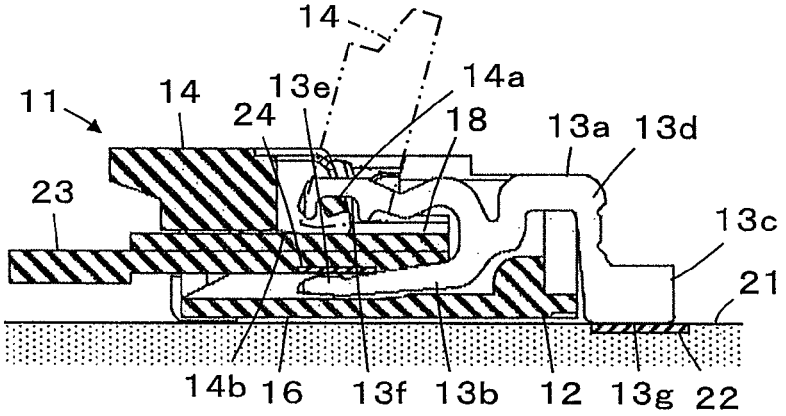
FIG. 9 is a sectional side view showing a state where a first connection object is connected to the electrical connector of Embodiment 1 which is mounted and fixed onto the second connection object.

When connecting a sheet-like or flat plate-shaped connection object 23 (first connection object), such as a flexible printed circuit (FPC) and a flexible flat cable (FFC), to the electrical connector 11, as indicated by a two-dot chain line in FIG. 9, in a state where the actuator 14 is rotated to the open position to open an upper part of the insertion portion 18 of the connection portion 16, the connection end of the connection object 23 is inserted to the innermost portion of the insertion portion 18. The plurality of wiring patterns 24 corresponding to the first contacts 13*e* of the plurality of contacts 13 of the electrical connector 11 is formed and arranged on the lower surface of the connection end of the connection object 23.

Thereafter, if the actuator 14 is rotated to place the actuator 14 at the closed position as indicated by a solid line in FIG. 9, a space between the pressing portion 14*b* having a cam structure of the actuator 14 and the bottom surface of the insertion portion 18 is narrowed, and the connection end of the connection object 23 inserted into the insertion portion 18 is pressed toward the bottom surface of the insertion portion 18 by the actuator 14. With this, the electrical connection between the wiring pattern 24 formed on the bottom surface of the connection end of the connection object 23 and the first contact point 13*e* of the contact 13 is established.

Simultaneously, the connection end of the connection object 23 is mechanically held between the actuator 14 and the bottom surface of the insertion portion 18 by a predetermined holding force.

The electrical connector 11 to which the connection object 23 is connected as described above is shown in FIG. 10.

The plurality of contacts 13 is not fixed and bound with respect to the circuit board 21 except that the second contacts 13*g* thereof are soldered and fixed to the corresponding wiring patterns 22 of the circuit board 21. Therefore, when deformation occurs due to external force acting on the circuit board 21 with the electrical connector 11 mounted thereon, or the like, each contact 13 is displaced in response to the deformation of the circuit board 21. In particular, the root portion of the tuning fork-shaped portion 13*b* and the curved portion 13*d* of the contact 13 have the large second clearances G2 between each contact 13 and the second groove portion 20*b* of the reception groove 20 of the connection portion 16, and accordingly, even if the amount of deformation of the circuit board 21 and the amount of deformation of the base member 12 are different from each other, it is possible to reduce a concern that the base member 12 interferes with the contact 13, and to prevent the soldered portion of the second contact point 13*g* of the contact 13 and the wiring pattern 22 of the circuit board 21 from being damaged.

Embodiment 2

Figure 11A:
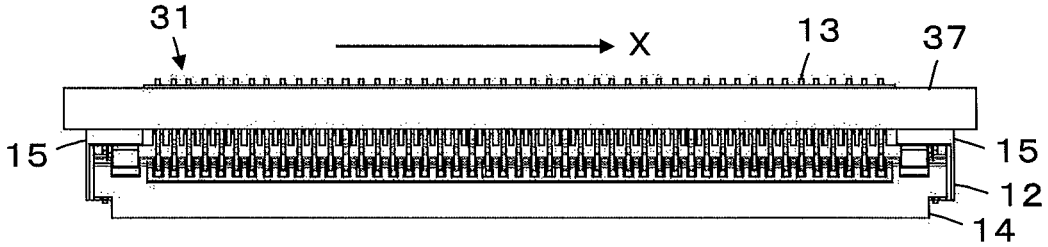
FIGS. 11A and 11B show an electrical connector according to Embodiment 2 of the present invention.
Figure 11B:
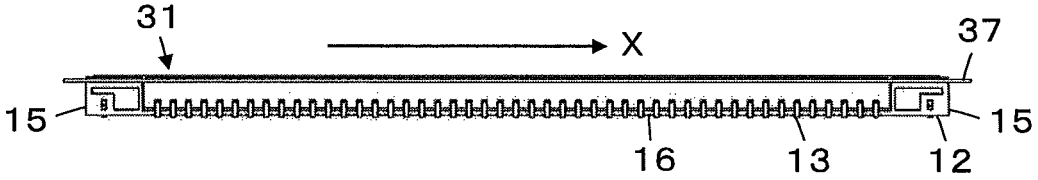
Figure 12A:
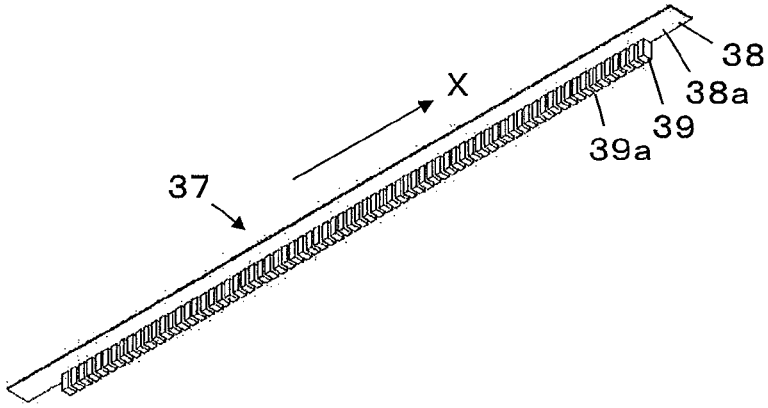
FIGS. 12A to 12G show a provisional contact fixing member used in the electrical connector according to Embodiment 2.
Figure 12B:
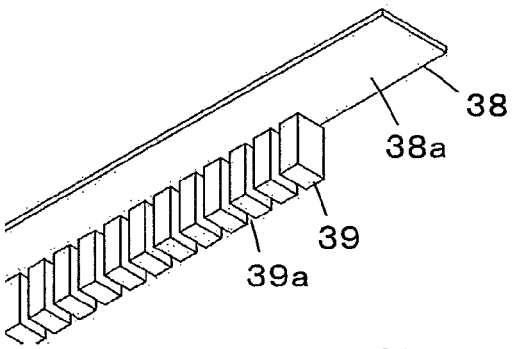
Figure 12C:
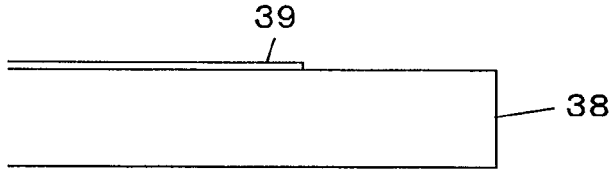
Figure 12D:
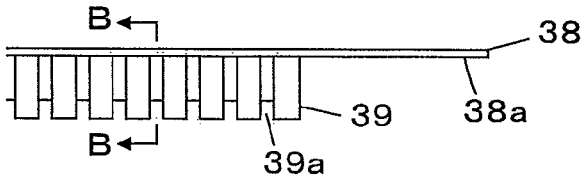
Figure 12E:
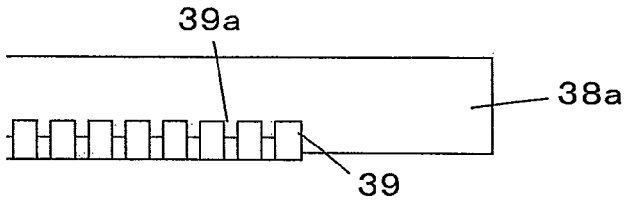
Figure 12F:
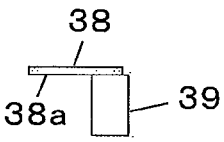
Figure 12G:
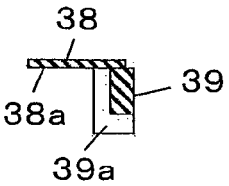

FIGS. 11A and 11B show the configuration of an electrical connector 31 according to Embodiment 2 of the present invention. The electrical connector 31 uses a provisional contact fixing member 37 instead of the provisional contact fixing member 17 in the electrical connector 11 of Embodiment 1, and other members are the same as those in the electrical connector 11 of Embodiment 1. That is, the electrical connector 31 includes the base member 12 extending in the X direction, the plurality of contacts 13 held by the base member 12, and the actuator 14 rotatably attached to the base member 12. The provisional contact fixing member 37 extending in the X direction is disposed to span a pair of mound portions 15 formed in both end portions of the base member 12.

As shown in FIGS. 12A to 12G, the provisional contact fixing member 37 has an adhesive tape 38 which is formed of polyimide or the like and extends in the X direction, and an arrangement auxiliary member 39 which is fixed to a lower surface 38*a* of the adhesive tape 38.

Figure 13:
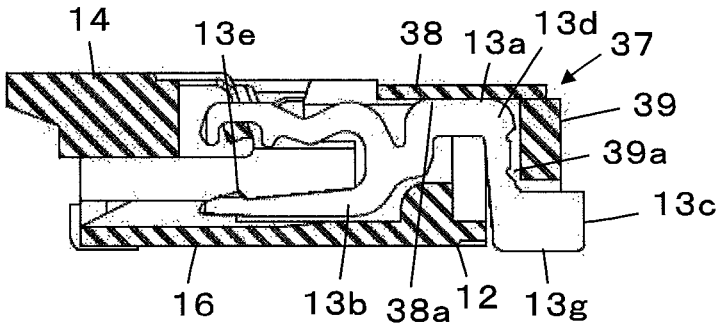
FIG. 13 is a sectional side view showing the electrical connector of Embodiment 2.

The arrangement auxiliary member 39 is a member which is made of, for example, an insulator, such as resins, and similarly to the adhesive tape 38, extends in the X direction. The arrangement auxiliary member 39 has a shorter length and a narrower width than the adhesive tape 38 and is formed to protrude downward from the lower surface 38*a* of the adhesive tape 38. In addition, in the arrangement auxiliary member 39, a plurality of arrangement grooves 39*a* corresponding to the plurality of contacts 13 is formed and arranged. The arrangement grooves 39*a* are formed slightly wider than the width in the X direction of the contacts 13 and are configured such that, as shown in FIG. 13, a portion of each of the contacts 13 is inserted into the corresponding arrangement groove 39*a*, and with this, the plurality of contacts 13 are arranged in accordance with the plurality of wiring patterns 22 arranged on the surface of the circuit board 21.

Figure 14:
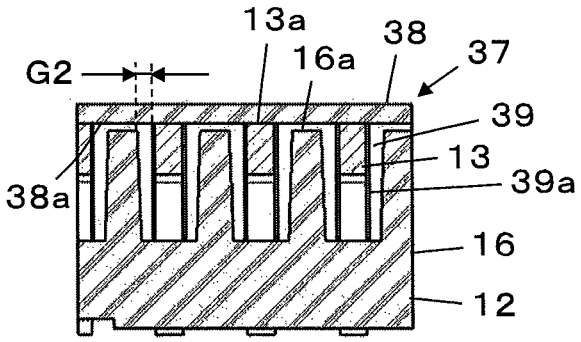
FIG. 14 is a sectional front view schematically showing a state where contacts are received in reception grooves formed in a base member of the electrical connector according to Embodiment 2.

As shown in FIG. 14, the plurality of contacts 13 is arranged on the connection portion 16 of the base member 12 in a state of being received in the corresponding reception grooves 20 of the connection portion 16 of the base member 12 and inserted into the corresponding arrangement grooves 39*a* of the provisional contact fixing member 37. Then, the lower surface 38*a* of the adhesive tape 38 of the provisional contact fixing member 37 is allowed to peelably adhere to the upper end surfaces 13*a* of the respective contacts 13. In addition, both end portions in the X direction of the lower surface 38*a* of the adhesive tape 38 of the provisional contact fixing member 37 are allowed to peelably adhere to the corresponding upper end surfaces 15*a* of the mound portions 15 of the base member 12. With this, the position of the upper end surface 13*a* of each of the plurality of contacts 13 is provisionally fixed through the provisional contact fixing member 37.

Similarly to the electrical connector 11 of Embodiment 1, the plurality of contacts 13 is received in the corresponding reception grooves 20 of the connection portion 16 of the base member 12, and is held by the provisional contact fixing member 37 such that the second clearances G2 are formed between each contact 13 and the connection portion 16.

The state where the electrical connector 31 according to Embodiment 2 is mounted on the surface of the circuit board 21 (second connection object) is the same as that in the electrical connector 11 of Embodiment 1 shown in FIG. 8. In a state where the rear portion of the curved portion 13*d* and the upper portion of the mounting portion 13*c* of each contact 13 are inserted into the arrangement groove 39*a* of the arrangement auxiliary member 39 of the provisional contact fixing member 37, and also the lower surface 38*a* of the adhesive tape 38 of the provisional fixing contact member 37 is allowed to peelably adhere to the upper end surface 13*a* of the contact 13, the second contact point 13*g* of the contact 13 is soldered to the corresponding wiring pattern 22 of the circuit board 21. After soldering is completed, the contact temporary fixing member 37 is no longer required and is thus removed.

Figure 10:
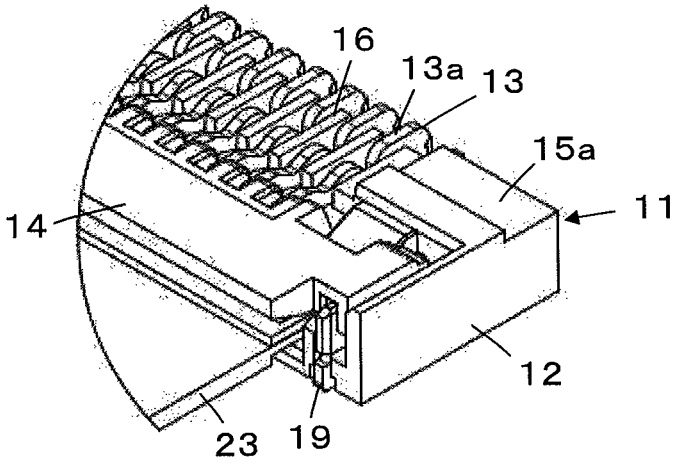
FIG. 10 is a partial enlarged perspective view showing a state where the first connection object is connected to the electrical connector of Embodiment 1 which is mounted and fixed onto the second connection object.

Accordingly, in the electrical connector 31 of Embodiment 2, the state where the connection object 23 (first connection object) is connected is also the same as that in the electrical connector 11 of Embodiment 1 shown in FIGS. 9 and 10.

As described above, even if the provisional contact fixing member 37 composed of the adhesive tape 38 and the arrangement auxiliary member 39 is used, similarly to Embodiment 1, the plurality of contacts 13 is not fixed and bound with respect to the circuit board 21 except that the second contact points 13*g* are soldered and fixed to the corresponding wiring patterns 22 of the circuit board 21. Therefore, even if deformation occurs due to external force acting on the circuit board 21 with the electrical connector 31 mounted thereon, or the like, it becomes possible to prevent the soldered portion of the second contact 13*g* of the contact 13 and the wiring pattern 22 of the circuit board 21 from being damaged.

In Embodiment 2, the contact 13 is inserted into the corresponding arrangement groove 39*a* of the arrangement auxiliary member 39 of the provisional contact fixing member 37 and with this, the plurality of contacts 13 is arranged in accordance with the plurality of wiring patterns 22 of the circuit board 21, and then, in this state, the lower surface 38*a* of the adhesive tape 38 is allowed to peelably adhere to the upper end surfaces 13*a* of the plurality of contacts 13. Accordingly, it is possible to improve workability when mounting the provisional contact fixing member 37 on the base member 12 and to easily arrange the plurality of contacts 13.

Embodiment 3

Figure 15A:
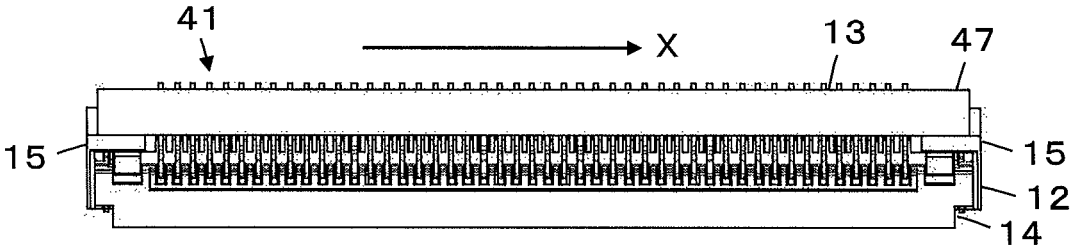
FIGS. 15A and 15B show an electrical connector according to Embodiment 3 of the present invention.
Figure 15B:
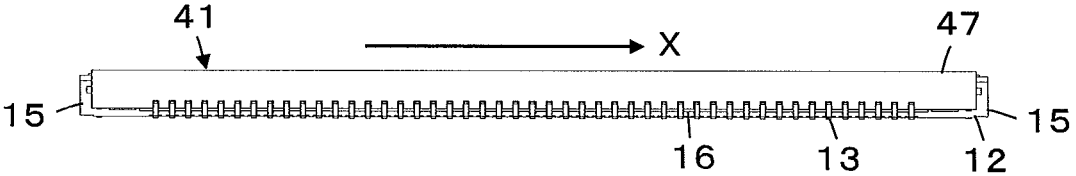
Figure 16A:
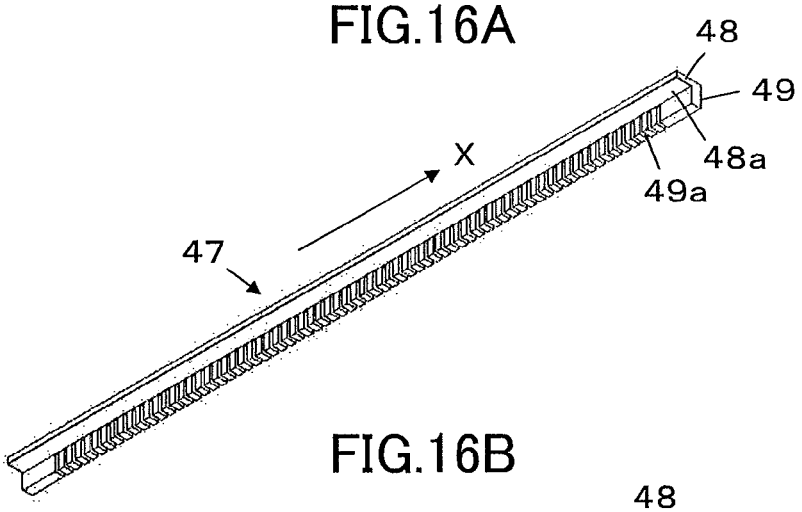
FIGS. 16A to 16G show a provisional contact fixing member used in the electrical connector according to Embodiment 3.
Figure 16B:
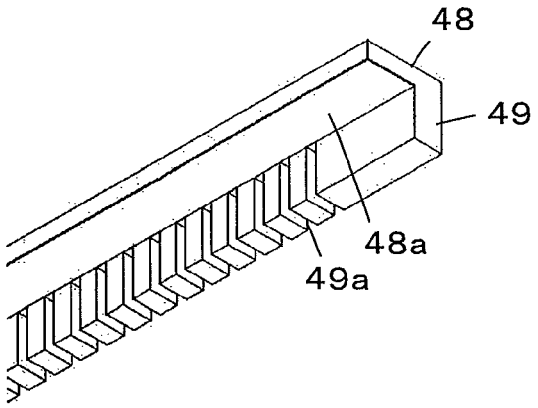
Figure 16C:
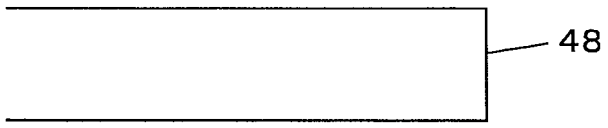
Figure 16D:
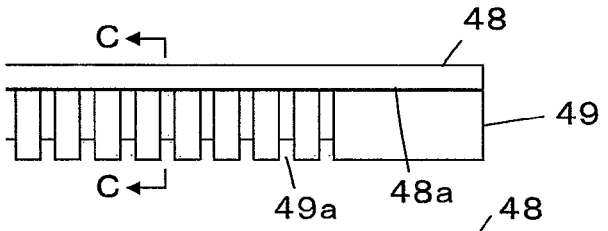
Figure 16E:
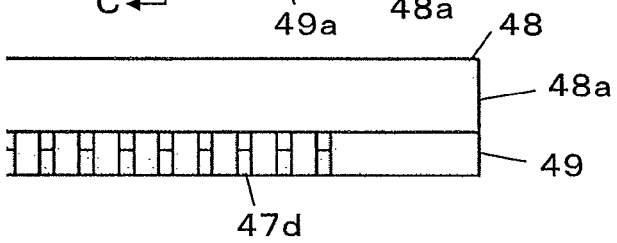
Figure 16F:
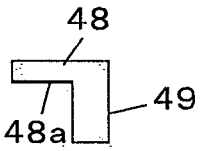
Figure 16G:
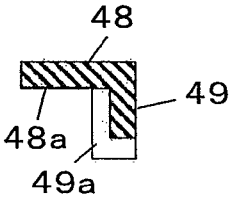

FIGS. 15A and 15B show the configuration of an electrical connector 41 according to Embodiment 3 of the present invention. The electrical connector 41 uses a provisional contact fixing member 47 instead of the provisional contact fixing member 17 in the electrical connector 11 of Embodiment 1, and other members are the same as those in the electrical connector 11 of Embodiment 1. That is, the electrical connector 41 includes the base member 12 extending in the X direction, the plurality of contacts 13 held by the base member 12, and the actuator 14 rotatably attached to the base member 12. The provisional contact fixing member 47 extending in the X direction is disposed to span a pair of mound portions 15 formed in both end portions of the base member 12.

Figure 17:
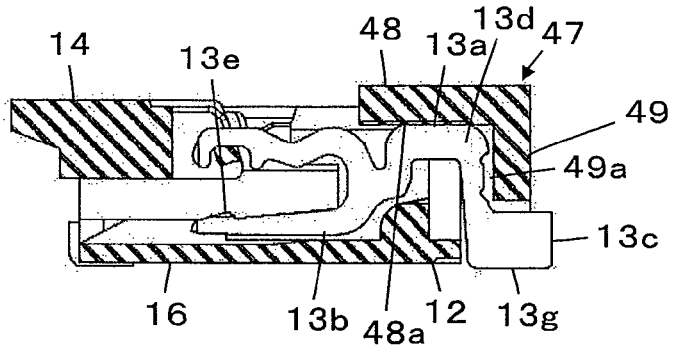
FIG. 17 is a sectional side view showing the electrical connector of Embodiment 3.

As shown in FIGS. 16A to 16G, the provisional contact fixing member 47 is a member which is made of an insulator, such as resins, extends in the X direction and has an L-shaped cross section. The provisional contact fixing member 47 has a horizontal portion 48 and a vertical portion 49 formed to protrude downward from the side edge of the horizontal portion 48. A lower surface 48*a* of the horizontal portion 48 forms an adhesive surface on which a peelable adhesive is coated. In the vertical portion 49, a plurality of arrangement grooves 49*a* corresponding to the plurality of contacts 13 is formed and arranged. The arrangement grooves 49*a* are formed slightly wider than the width in the X direction of the contacts 13 and are configured such that, as shown in FIG. 17, a portion of each of the contacts 13 is inserted into the corresponding arrangement groove 49*a* and with this, the plurality of contacts 13 is arranged in accordance with the plurality of wiring patterns 22 arranged on the surface of the circuit board 21.

Figure 18:
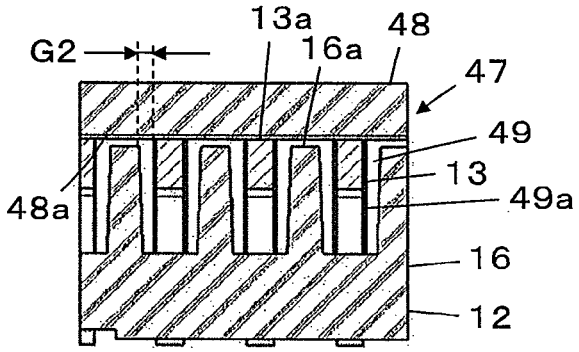
FIG. 18 is a sectional front view schematically showing a state where contacts are received in reception grooves formed in a base member of the electrical connector according to Embodiment 3.

As shown in FIG. 18, the plurality of contacts 13 is arranged on the connection portion 16 of the base member 12 in a state of being received in the corresponding reception grooves 20 of the connection portion 16 of the base member 12 and inserted into the corresponding arrangement grooves 49*a* of the provisional contact fixing member 37. Then, the lower surface 48*a* of the horizontal portion 48 of the provisional contact fixing member 47 is allowed to peelably adhere to the upper end surfaces 13*a* of the respective contacts 13. In addition, both end portions in the X direction of the lower surface 48*a* of the horizontal portion 48 of the provisional contact fixing member 47 are allowed to peelably adhere to the corresponding upper end surfaces 15*a* of the mound portions 15 of the base member 12. With this, the position of the upper end surface 13*a* of each of the plurality of contacts 13 is provisionally fixed through the provisional contact fixing member 47.

Similarly to the electrical connector 11 of Embodiment 1, the plurality of contacts 13 is received in the corresponding reception grooves 20 of the connection portion 16 of the base member 12, and is held by the provisional contact fixing member 47 such that the second clearances G2 are formed between each contact 13 and the connection portion 16.

The state where the electrical connector 41 according to Embodiment 3 is mounted on the surface of the circuit board 21 (second connection object) is the same as that in the electrical connector 11 of Embodiment 1 shown in FIG. 8. In a state where the rear portion of the curved portion 13*d* and the upper portion of the mounting portion 13*c* of each contact 13 are inserted into the arrangement groove 49*a* of the vertical portion 49 of the provisional contact fixing member 47, and also the lower surface 48*a* of the horizontal portion 48 of the provisional contact fixing member 47 is allowed to peelably adhere to the upper end surface 13*a* of the contact 13, the second contact point 13*g* of the contact 13 is soldered to the corresponding wiring pattern 22 of the circuit board 21. After soldering is completed, the provisional contact fixing member 47 is no longer required and is thus removed.

Accordingly, in the electrical connector 41 of Embodiment 3, the state where the connection object 23 (first connection object) is connected is also the same as that in the electrical connector 11 of Embodiment 1 shown in FIGS. 9 and 10.

As described above, even if the provisional contact fixing member 47 which is a single member having the lower surface 48*a* of the horizontal portion 48 as an adhesive surface and the plurality of arrangement grooves 49*a* of the vertical portion 49 is used, similarly to Embodiments 1 and 2, the plurality of contacts 13 is not fixed and bound with respect to the circuit board 21 except that the second contact points 13*g* are soldered and fixed to the corresponding wiring patterns 22 of the circuit board 21. Therefore, even if deformation occurs due to external force acting on the circuit board 21 with the electrical connector 41 mounted thereon, or the like, it becomes possible to prevent the soldered portion of the second contact point 13*g* of the contact 13 and the wiring pattern 22 of the circuit board 21 from being damaged.

Also in Embodiment 3, similarly to Embodiment 2, the contact 13 is inserted into the corresponding arrangement groove 49*a* of the provisional contact fixing member 47 and with this, the plurality of contacts 13 is arranged in accordance with the plurality of wiring patterns 22 of the circuit board 21, and then, in this state, the lower surface 48*a* of the horizontal portion 48 is allowed to peelably adhere to the upper end surfaces 13*a* of the plurality of contacts 13. Accordingly, it becomes possible to improve workability when mounting the provisional contact fixing member 47 on the base member 12 and to easily arrange the plurality of contacts 13. In addition, since the provisional contact fixing member 47 is formed of a single member, it is possible to simplify the manufacturing process of the electrical connector 31 and to achieve reduction in manufacturing cost, compared to the electrical connector 31 of Embodiment 2.

Embodiment 4

Figure 19A:
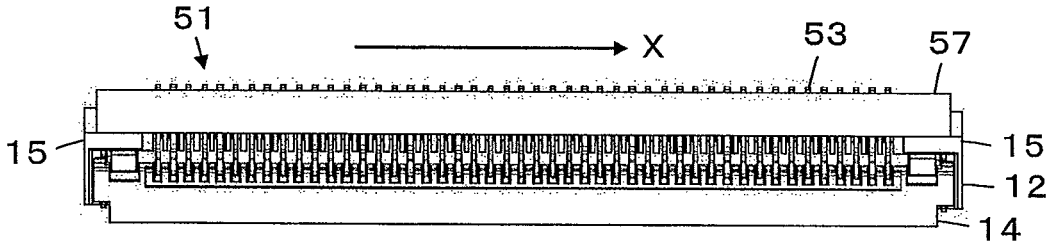
FIGS. 19A and 19B show an electrical connector according to Embodiment 4 of the present invention.
Figure 19B:
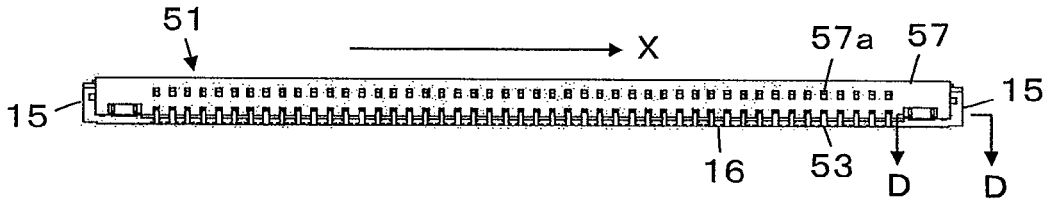

FIGS. 19A and 19B show the configuration of an electrical connector 51 according to Embodiment 4 of the present invention. The electrical connector 51 uses a plurality of contacts 53 and a provisional contact fixing member 57 instead of the plurality of contacts 13 and the provisional contact fixing member 17 in the electrical connector 11 of Embodiment 1, and other members are the same as those in the electrical connector 11 of Embodiment 1. That is, the electrical connector 51 includes the base member 12 extending in the X direction, the plurality of contacts 53 held by the base member 12, the actuator 14 rotatably attached to the base member 12, and the provisional contact fixing member 57 extending in the X direction to span both mound portions 15 of the base member 12. As shown in FIG. 19B, in the provisional contact fixing member 57, a plurality of protrusion insertion holes 57*a* (provisional fixing portions A) corresponding to the plurality of contacts 53 is formed and arranged in the X direction.

As shown in FIGS. 20A to 20G, the provisional contact fixing member 57 is a member which is made of, for example, an insulator, such as resins, extends in the X direction and has an L-shaped cross section. The provisional contact fixing member 57 has a horizontal portion 58 and a vertical portion 59 formed to protrude downward from the side edge of the horizontal portion 58. In the vertical portion 59, a plurality of arrangement grooves 59*a* which corresponds to the plurality of contacts 53 and each of which has a width slightly wider than the width in the X direction of the contact 53 is formed and arranged.

In both end portions in the X direction of the provisional contact fixing member 57, projections 60 (fitting portions) which protrude in a vertical direction (that is, in a direction parallel to the horizontal portion 58) from the wall surface of the vertical portion 59 are formed. Each of the projections 60 has a pair of arm portions 60*a* which protrude from the vertical portion 59 in parallel with each other and a pair of claw portions 60*b* which protrude from the tips of the respective arm portions 60*a* in opposite directions with each other.

Figure 20A:
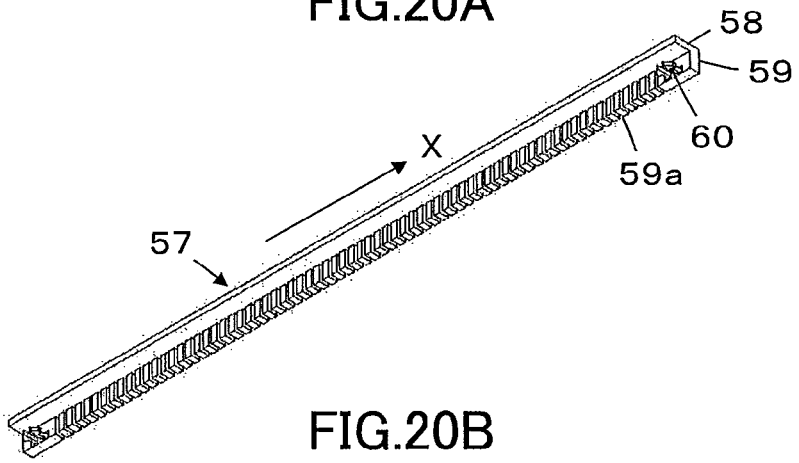
FIGS. 20A to 20G show a provisional contact fixing member used in the electrical connector according to Embodiment 4.
Figure 20B:
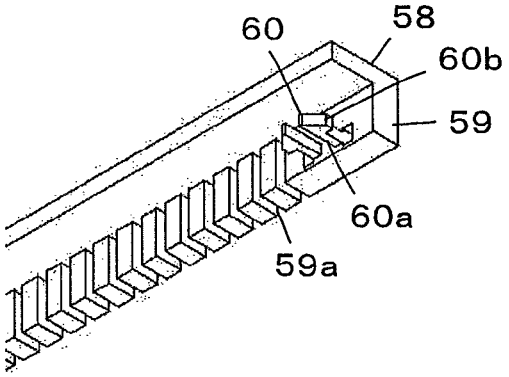
Figure 20C:
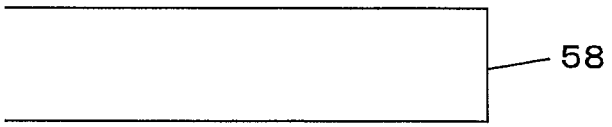
Figure 20D:
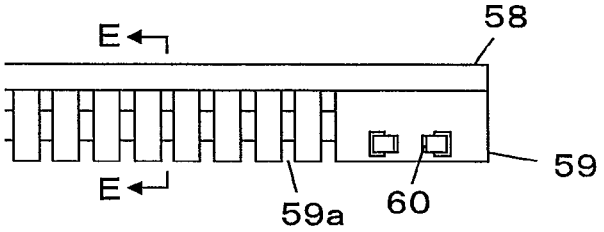
Figure 20E:
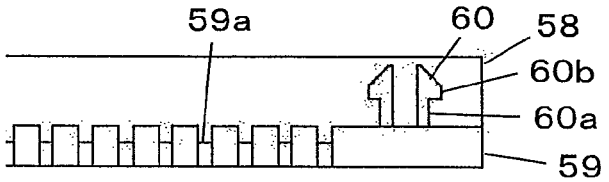
Figure 20F:
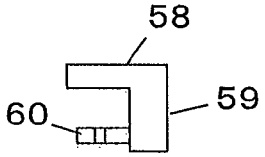
Figure 20G:
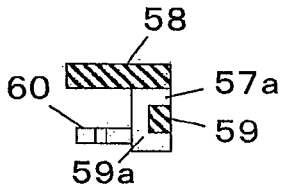

As shown in FIG. 20G, each of protrusion insertion holes 57*a* is formed to pass through the wall surface of the vertical portion 59 and to be connected to the corresponding arrangement groove 59*a*.

Figure 21:
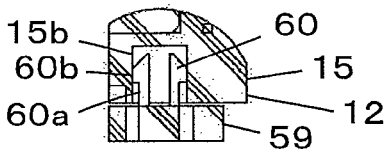
FIG. 21 is a sectional view taken along the line D-D of FIG. 19B.

As shown in FIG. 21, in the rear portions of a pair of mound portions 15 disposed in both end portions of the base member 12, projection insertion holes 15*b* (fitted portions) corresponding to the projections 60 of the provisional contact fixing member 57 are respectively formed. If the tips of the arm portions 60*a* of the projections 60 of the provisional contact fixing member 57 are positioned in the projection insertion holes 15*b* and the provisional contact fixing member 57 is pressed toward the front portion of the base member 12 in which the actuator 14 is disposed, the claw portions 60*b* come into contact with the inner surfaces of the projection insertion holes 15*b* and a pair of arm portions 60*a* are fitted in the projection insertion holes 15*b* in an elastically compressed state. With this, the provisional contact fixing member 57 is detachably fixed to the base member 12.

Figure 22:
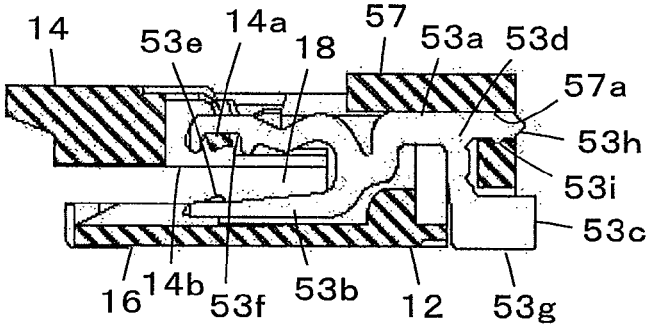
FIG. 22 is a sectional side view showing the electrical connector of Embodiment 4.

As shown in FIG. 22, similarly to the contacts 13 in Embodiment 1 shown in FIG. 4, each of the contacts 53 has a curved portion 53*d* which is curved upward in a convex shape between a forked tuning fork-shaped portion 53*b* and a rectangular mounting portion 53*c*. A first contact point 53*e* which is a spring contact point is formed in the lower end portion of the tuning fork-shaped portion 53*b*, and a concave portion 53*f* which is hooked to the rod-like portion 14*a* of the actuator 14 is formed in the upper end portion of the tuning fork-shaped portion 53*b*. A flat upper end surface 53*a* is formed on the upper surface of the curved portion 53*d*, and a flat second contact point 53*g* is formed on the lower surface of the mounting portion 53*c*.

Further, unlike the contacts 13 in Embodiment 1, each of the contacts 53 has a protrusion 53*h* (provisional fixing portion B) which extends rearward from the curved portion 53*d* in parallel with the mounting portion 53*c*. In addition, in the protrusion 53*h*, a convex portion 53*i* which slightly protrudes toward the mounting portion 53*c* is formed.

Then, if the protrusion 53*h* of each of the contacts 53 is inserted into the corresponding protrusion insertion hole 57*a* formed in the vertical portion 59 of the provisional contact fixing member 57, the convex portion 53*i* formed in the protrusion 53*h* is pressed against the inner surface of the protrusion insertion hole 57*a*, and the protrusion 53*h* is fitted in the protrusion insertion hole 57*a* and temporarily fixed (is engaged with the protrusion insertion hole 57*a* and locked). In each of the contacts 53, the protrusion 53*h* is inserted into the protrusion insertion hole 57*a*, and with this, the rear portion of the curved portion 53*d* and the upper portion of the mounting portion 53*c* are inserted into the arrangement groove 59*a* of the provisional contact fixing member 57. Therefore, the plurality of contacts 53 is held by the provisional contact fixing member 57 in a state of being arranged in accordance with the plurality of wiring patterns 22 which is formed and arranged on the surface of the circuit board 21.

Figure 23:
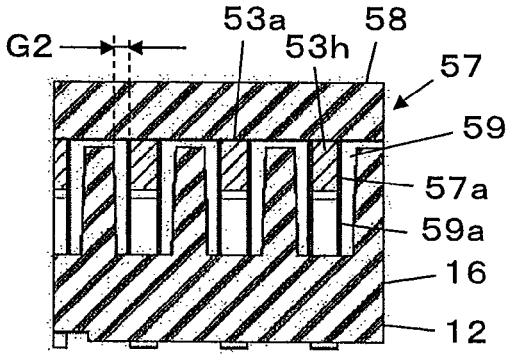
FIG. 23 is a sectional front view schematically showing a state where contacts are received in reception grooves formed in a base member of the electrical connector according to Embodiment 4.

If the projections 60 of the provisional contact fixing member 57, by which the plurality of contacts 53 is held, are fitted in the projection insertion holes 15*b* of the base member 12, as shown in FIG. 23, the plurality of contacts 53 is arranged on the connection portion 16 of the base member 12 in a state of being inserted into the corresponding arrangement grooves 59*a* of the provisional contact fixing member 57. At this time, the protrusion 53*h* of each of the contacts 53 is fitted in the corresponding protrusion insertion hole 57*a* of the provisional contact fixing member 57, whereby the position of each of the plurality of contacts 53 is provisionally fixed through the provisional contact fixing member 57.

Similarly to the electrical connector 11 of Embodiment 1, the plurality of contacts 53 is received in the corresponding reception grooves 20 of the connection portion 16 of the base member 12, and is held by the provisional contact fixing member 57 such that the second clearances G2 are formed between each contact 53 and the connection portion 16.

In this way, even if the provisional contact fixing member 57 does not have an adhesive surface to be allowed to adhere to the contacts 53, it becomes possible to provisionally fix the plurality of contacts 53.

Figure 24:
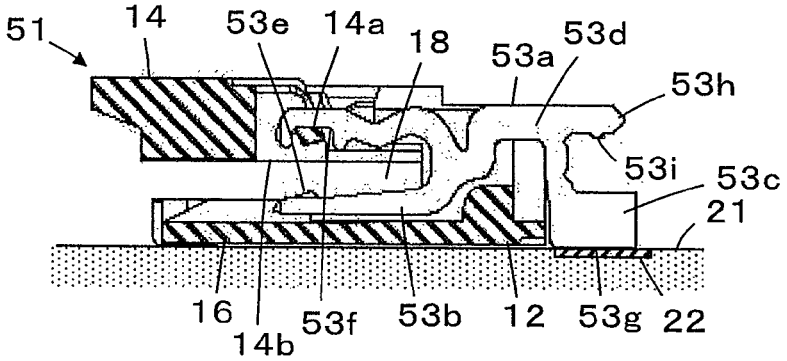
FIG. 24 is a sectional side view showing the electrical connector of Embodiment 4 which is mounted and fixed onto a second connection object.

As shown in FIG. 24, the state where the electrical connector 51 according to Embodiment 4 is mounted on the surface of the circuit board 21 (second connection object) is the same as that in the electrical connector 11 of Embodiment 1 shown in FIG. 8. That is, in a state where the protrusion 53*h* of each contact 53 is inserted into the protrusion insertion hole 57*a* of the provisional contact fixing member 57, and also the rear portion of the curved portion 53*d* and the upper portion of the mounting portion 53*c* of the contact 53 are inserted into the arrangement groove 59*a* of the provisional contact fixing member 57, the second contact point 53*g* of the contact 53 is soldered to the corresponding wiring pattern 22 of the circuit board 21. After soldering is completed, the provisional contact fixing member 57 is no longer required and is thus removed.

When removing the provisional contact fixing member 57, the provisional contact fixing member 57 may slide rearward with respect to the base member 12, that is, in a direction away from the actuator 14 in parallel with the surface of the circuit board 21 and may be pulled out. With this, the projections 60 of the provisional contact fixing member 57 inserted into the projection insertion holes 15*b* of a pair of mound portions 15 are separated from the mound portions 15, and also the protrusions 53*h* of the plurality of contacts 53 are separated from the corresponding protrusion insertion holes 57*a* of the provisional contact fixing member 57.

Figure 25:
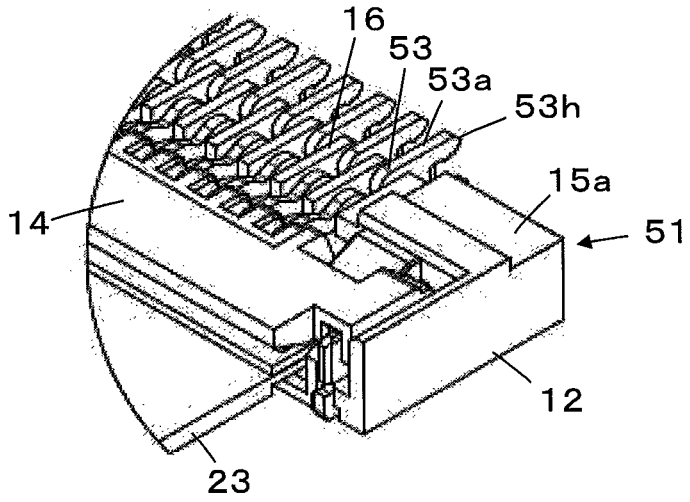
FIG. 25 is a partial enlarged perspective view showing a state where a first connection object is connected to the electrical connector of Embodiment 4 which is mounted and fixed onto the second connection object.

The provisional contact fixing member 57 is removed from the electrical connector 51 after the electrical connector 51 is mounted on the circuit board 21, and thus, as shown in FIG. 25, in the electrical connector 51 of Embodiment 4, the state where the connection object 23 (first connection object) is connected is also the same as that in the electrical connector 11 of Embodiment 1 shown in FIGS. 9 and 10.

As described above, even if the provisional contact fixing member 57 with no adhesive surface is used, similarly to Embodiments 1 to 3, the plurality of contacts 53 is not fixed and bound with respect to the circuit board 21 except that the second contact points 53*g* are soldered and fixed to the corresponding wiring patterns 22 of the circuit board 21. Therefore, even if deformation occurs due to external force acting on the circuit board 21 with the electrical connector 51 mounted thereon or the like, it becomes possible to prevent the soldered portion of the second contact point 53*g* of the contact 53 and the wiring pattern 22 of the circuit board 21 from being damaged.

In Embodiment 4, in a state where the protrusion 53*h* of each of the contacts 53 is inserted into the protrusion insertion hole 57*a* of the provisional contact fixing member 57, and also the rear portion of the curved portion 53*d* and the upper portion of the mounting portion 53*c* of the contact 53 are inserted into the arrangement groove 59*a* of the provisional contact fixing member 57, the plurality of contacts 53 is mounted on the base member 12 along with the provisional contact fixing member 57. Accordingly, it becomes possible to easily arrange the plurality of contacts 53 on the base member 12.

In addition, in Embodiment 4, although the projections 60 (fitting portions) of the provisional contact fixing member 57 are inserted into the projection insertion holes 15*b* (fitted portions) of the mound portions 15 of the base member 12 to detachably fix the provisional contact fixing member 57 to a pair of mound portions 15, in contrast, projections which are fitting portions may be formed in the mound portions 15, and projection insertion holes which are fitted portions may be formed in the provisional contact fixing member 57.

Embodiment 5

Figure 26A:
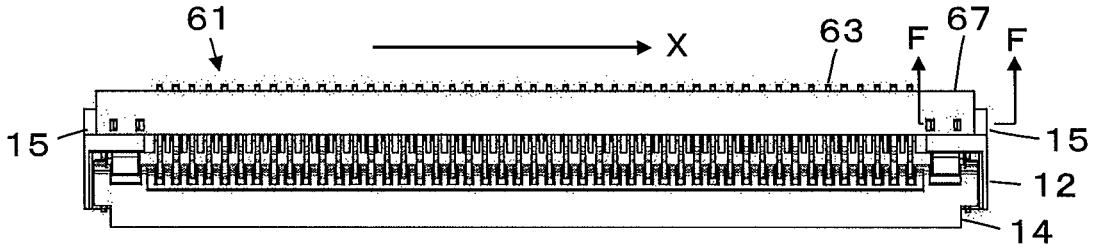
FIGS. 26A and 26B show an electrical connector according to Embodiment 5 of the present invention.
Figure 26B:
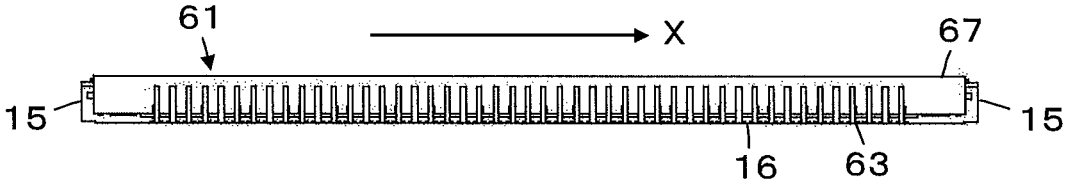
Figure 27A:
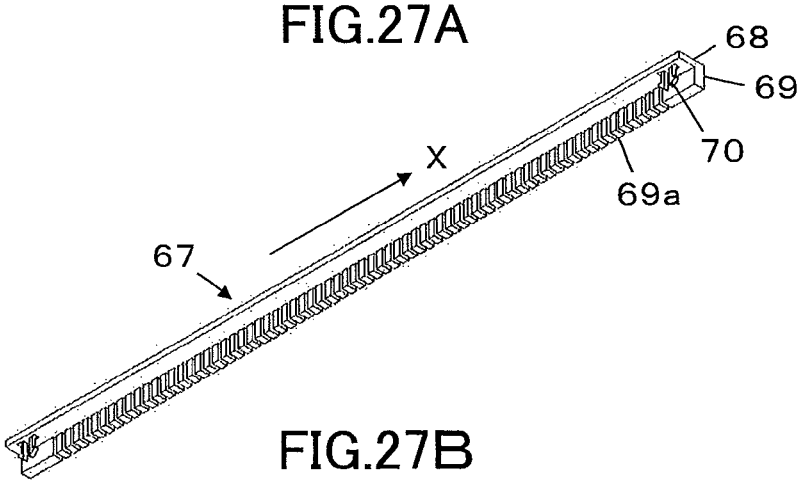
FIGS. 27A to 27G show a provisional contact fixing member used in the electrical connector according to Embodiment 5.
Figure 27B:
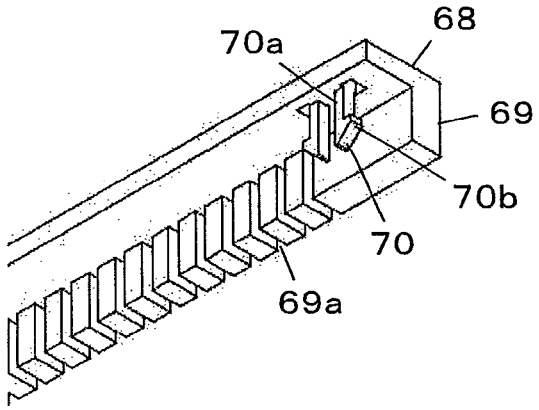
Figure 27C:
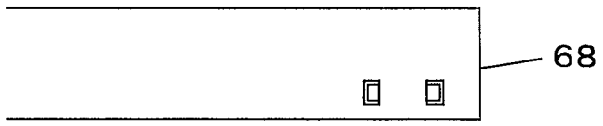
Figure 27D:
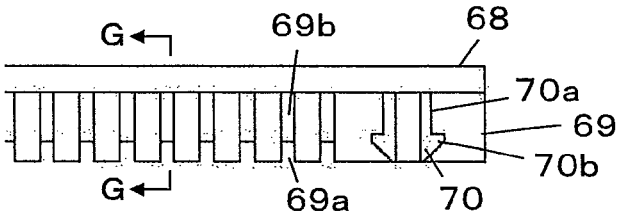
Figure 27E:
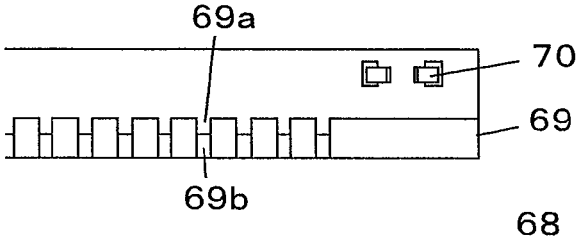
Figure 27F:
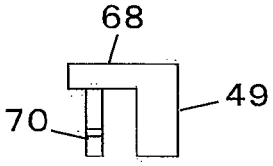
Figure 27G:
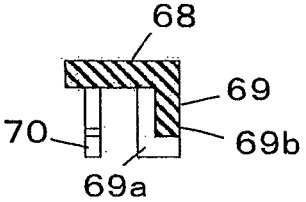

FIGS. 26A and 26B show the configuration of an electrical connector 61 according to Embodiment 5 of the present invention. The electrical connector 61 uses a plurality of contacts 63 and a provisional contact fixing member 67 instead of the plurality of contacts 13 and the provisional contact fixing member 17 in the electrical connector 11 of Embodiment 1, and other members are the same as those in the electrical connector 11 of Embodiment 1. That is, the electrical connector 61 includes the base member 12 extending in the X direction, the plurality of contacts 53 held by the base member 12, the actuator 14 rotatably attached to the base member 12, and the provisional contact fixing member 67 extending in the X direction to span both mound portions 15 of the base member 12.

As shown in FIGS. 27A to 27G, the provisional contact fixing member 67 is a member which is made of, for example, an insulator, such as resins, extends in the X direction and has an L-shaped cross section. The provisional contact fixing member 67 has a horizontal portion 68 and a vertical portion 69 formed to protrude downward from the side edge of the horizontal portion 68. In the vertical portion 69, a plurality of arrangement grooves 69*a* which corresponds to the plurality of contacts 63 and each of which has a width slightly wider than the width in the X direction of the contact 63 is formed and arranged, and a plate-like portion 69*b* is formed to fill a rear portion and an upper portion in each of the arrangement grooves 69*a*.

In both end portions in the X direction of the provisional contact fixing member 67, projections 70 (fitting portions) which protrude in a vertical direction (that is, in a direction parallel to the vertical portion 69) from the lower surface of the horizontal portion 68 are formed. Each of the projections 70 has a pair of arm portions 70*a* which protrude from the horizontal portion 68 in parallel with each other and a pair of claw portions 70*b* which protrude from the tips of the respective arm portions 70*a* in opposite directions with each other.

Figure 28:
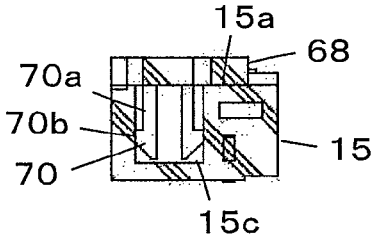
FIG. 28 is a sectional view taken along the line F-F of FIG. 26A.

As shown in FIG. 28, in a pair of mound portions 15 disposed in both end portions of the base member 12, projection insertion holes 15*c* (fitted portions) corresponding to the projections 70 of the provisional contact fixing member 67 are respectively formed to extend downward from the upper end surfaces 15*a* of the mound portions 15. If the tips of the arm portions 70*a* of the projections 70 of the provisional contact fixing member 67 are positioned in the projection insertion holes 15*c* and the provisional contact fixing member 67 is pressed downward, the claw portions 70*b* come into contact with the inner surfaces of the projection insertion holes 15*c* and a pair of arm portions 70*a* are fitted in the projection insertion, holes 15*c* in an elastically compressed state. With this, the provisional contact fixing member 67 is detachably fixed to the base member 12.

Figure 29:
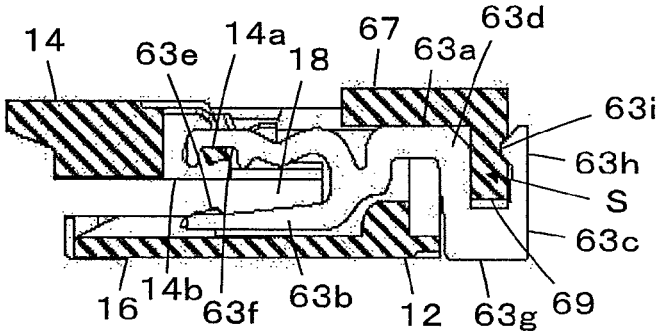
FIG. 29 is a sectional side view showing the electrical connector of Embodiment 5.

As shown in FIG. 29, similarly to the contacts 13 in Embodiment 1 shown in FIG. 4, each of the contacts 63 has a curved portion 63*d* which is curved upward in a convex shape between a forked tuning fork-shaped portion 63*b* and a rectangular mounting portion 63*c*. A first contact point 63*e* which is a spring contact point is formed in the lower portion of the tuning fork-shaped portion 63*b*, and a concave portion 63*f* which is hooked to the rod-like portion 14*a* of the actuator 14 is formed in the upper portion of the tuning fork-shaped portion 63*b*. A flat upper end surface 63*a* is formed on the upper surface of the curved portion 63*d*, and a flat second contact point 63*g* is formed on the lower surface of the mounting portion 63*c*.

Further, unlike the contacts 13 in Embodiment 1, each of the contacts 63 has a U-shaped portion 63*h* (provisional fixing portion B) in the upper portion of the mounting portion 63*c*. The U-shaped portion 63*h* is adjacent to the curved portion 63*d*, and an insertion space S which is opened upward is formed inside the U shape. At the tip of the U-shaped portion 63*h*, a convex portion 63*i* which slightly protrudes toward the insertion space S is formed. The plate-like portion 69*b* of the vertical portion 69 of the provisional contact fixing member 67 is inserted into the insertion space S as the provisional fixing portion A, and the width of the insertion space S in a portion, in which the convex portion 63*i* is formed, is slightly narrower than the thickness of the plate-like portion 69*b* of the provisional contact fixing member 67.

Then, if the plate-like portion 69*b* of the provisional contact fixing member 67 is inserted into the corresponding insertion space S of the U-shaped portion 63*h*, while inserting the rear portion of the curved portion 63*d* and the upper portion of the mounting portion 63*c* of each of the contacts 63 into the arrangement groove 69*a* of the provisional contact fixing member 67, the U-shaped portion 63*h* is slightly widened by the plate-like portion 69*b* to press the convex portion 63*i* against the plate-like portion 69*b*, and the plate-like portion 69*b* of the provisional contact fixing member 67 is fitted in the insertion space S. That is, the U-shaped portion 63*h* of the contact 63 is temporarily fixed to the plate-like portion 69*b* of the provisional contact fixing member 67 (is engaged with the plate-like portion 69*b* and locked). With this, the plurality of contacts 63 is held by the provisional contact fixing member 67 in a state of being arranged in accordance with the plurality of wiring patterns 22 arranged on the surface of the circuit board 21.

Figure 30:
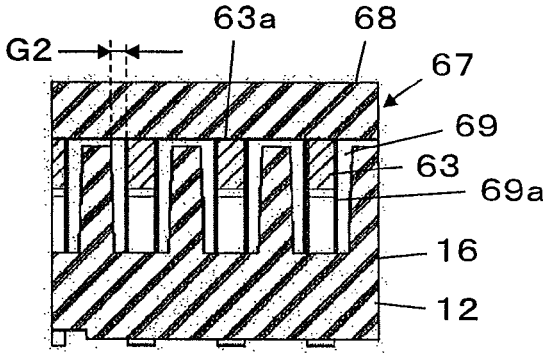
FIG. 30 is a sectional front view schematically showing a state where contacts are received in reception grooves formed in a base member of the electrical connector according to Embodiment 5.

If the projections 70 of the provisional contact fixing member 67, by which the plurality of contacts 63 are held, are fitted in the projection insertion holes 15*c* of the base member 12, as shown in FIG. 30, the plurality of contacts 63 is arranged on the connection portion 16 of the base member 12 in a state of being inserted into the corresponding arrangement grooves 69*a* of the provisional contact fixing member 67. At this time, each of the plurality of plate-like portions 69*b* of the provisional contact fixing member 67 is inserted into the insertion space S of the U-shaped portion 63*h* of the corresponding contact 63, whereby the position of each of the plurality of contacts 63 is provisionally fixed through the provisional contact fixing member 67.

Similarly to the electrical connector 11 of Embodiment 1, the plurality of contacts 63 is received in the corresponding reception grooves 20 of the base member 12, and is held by the provisional contact fixing member 67 such that the second clearances G2 are formed between each contact 63 and the connection portion 16.

In this way, even if the provisional contact fixing member 67 does not have an adhesive surface to be allowed to adhere to the contacts 63, it becomes possible to provisionally fix the plurality of contacts 63.

Figure 31:
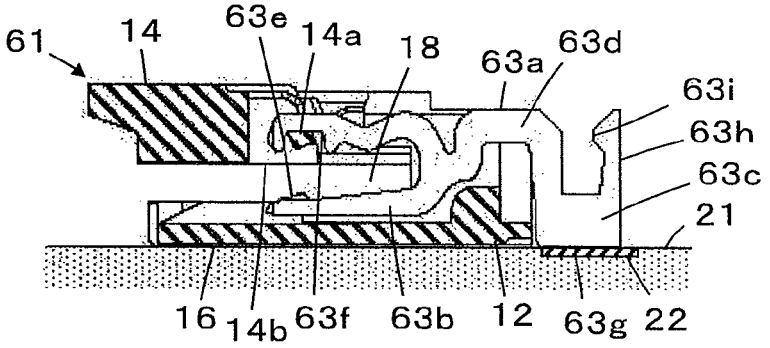
FIG. 31 is a sectional side view showing the electrical connector of Embodiment 5 which is mounted and fixed onto a second connection object.

As shown in FIG. 31, the state where the electrical connector 61 according to Embodiment 5 is mounted on the surface of the circuit board 21 (second connection object) is the same as that in the electrical connector 11 of Embodiment 1 shown in FIG. 8. That is, in a state where the rear portion of the curved portion 63*d* and the upper portion of the mounting portion 63*c* of each of the contacts 63 are inserted into the arrangement groove 69*a* of the provisional contact fixing member 67, and also the plate-like portion 69*b* of the provisional contact fixing member 67 is inserted into the insertion space S of the U-shaped portion 63*h*, the second contact point 63*g* of the contact 63 is soldered to the corresponding wiring pattern 22 of the circuit board 21. After soldering is completed, the provisional contact fixing member 67 is no longer required and is thus removed.

When removing the provisional contact fixing member 67, the provisional contact fixing member 67 may slide upward with respect to the base member 12, that is, in a direction away vertically from the surface of the circuit board 21 and may be pulled out. With this, the projections 70 of the provisional contact fixing member 67 inserted into the projection insertion holes 15*c* of a pair of mound portions 15 are separated from the mound portions 15, and also the plate-like portions 69*b* of the provisional contact fixing member 67 fitted in the U-shaped portions 63*h* of the plurality of contacts 63 are separated from the contacts 63.

Figure 32:
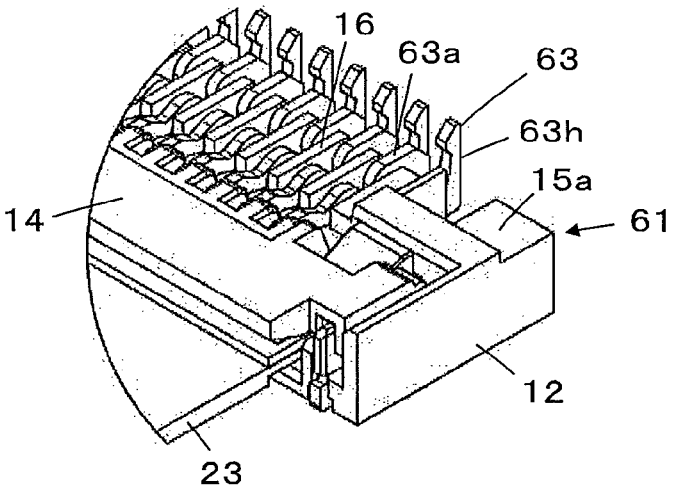
FIG. 32 is a partial enlarged perspective view showing a state where a first connection object is connected to the electrical connector of Embodiment 5 which is mounted and fixed onto the second connection object.

The provisional contact fixing member 67 is removed from the electrical connector 61 after the electrical connector 61 is mounted on the circuit board 21, and thus, as shown in FIG. 32, in the electrical connector 61 of Embodiment 5, the state in which the connection object 23 (first connection object) is connected is also the same as that in the electrical connector 11 of Embodiment 1 shown in FIGS. 9 and 10.

Even if the above-described fixing member 67 is used, similarly to Embodiments 1 to 4, the plurality of contacts 63 is not fixed and bound with respect to the circuit board 21 except that the second contact points 63*g* are soldered and fixed to the corresponding wiring patterns 22 of the circuit board 21. Therefore, even if deformation occurs due to external force acting on the circuit board 21 with the electrical connector 61 mounted thereon or the like, it becomes possible to prevent the soldered portion of the second contact point 63*g* of the contact 63 and the wiring pattern 22 of the circuit board 21 from being damaged.

In Embodiment 5, in a state where the rear portion of the curved portion 63*d* and the upper portion of the mounting portion 63*c* of each of the contacts 63 are inserted into the arrangement groove 69*a* of the provisional contact fixing member 67, and also the plate-like portion 69*b* of the provisional contact fixing member 67 is fitted in the insertion space S of the U-shaped portion 63*h*, the plurality of contacts 63 is mounted on the base member 12 along with the provisional contact fixing member 67. Accordingly, it becomes possible to easily arrange the plurality of contacts 63 on the base member 12.

In Embodiment 5, although the projections 70 (fitting portions) of the provisional contact fixing member 67 are inserted into the projection insertion holes 15*c* (fitted portions) of the mound portions 15 of the base member 12 to detachably fix the provisional contact fixing member 67 to a pair of mound portions 15, in contrast, projections which are fitting portions may be formed in the mound portions 15, and projection insertion holes which are fitted portions may be formed in the provisional contact fixing member 67.

Embodiment 6

Figure 33:
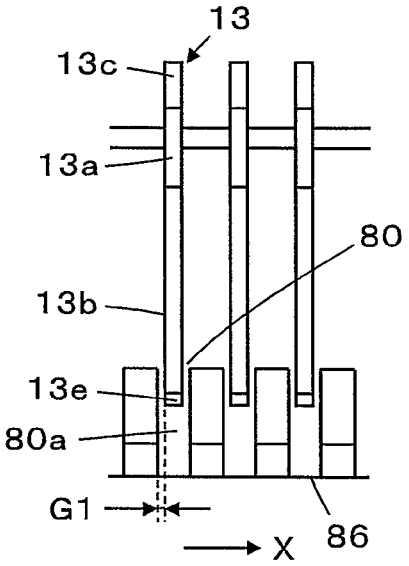
FIG. 33 is a plan view schematically showing a state where contacts are received in reception grooves formed in a base member of the electrical connector according to Embodiment 6 of the present invention.
Figure 34:
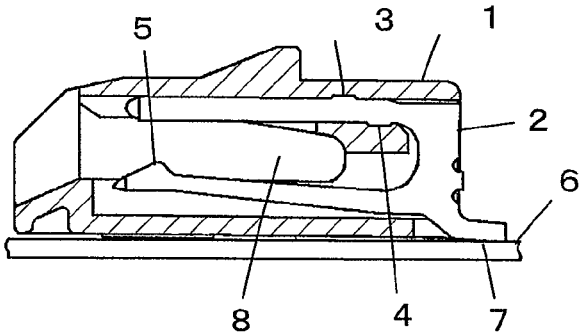
FIG. 34 is a sectional view showing the conventional connector.

In the above-described Embodiment 1, although each of the plurality of reception grooves 20 formed in the connection portion 16 of the base member 12 has the first groove portion 20*a* which receives the first contact point 13*e* side of each of the contacts 13 and the second groove portion 20*b* which receives the second contact point 13*g* side of the contact 13, the invention is not limited thereto, and like a connection portion 86 shown in FIG. 33, each of reception grooves 80 may have only a first groove portion 80*a* which receives the periphery of the first contact point 13*e* of each of the contacts 13.

Similarly to the first groove portion 20*a* in Embodiment 1 shown in FIG. 6, the first groove portion 80*a* is configured such that a very small first clearance G1 is formed on each side of the contact 13 received. That is, the reception groove 80 receive only the first contact point 13*e* side of the contact 13, and positions the first contact point 13*e* side in the X direction which is the arrangement direction of the contacts 13. While there is no reception groove 80 on the second contact point 13*g* side of the contact 13, the provisional contact fixing member 17, 37, or 47 is allowed to peelably adhere to the upper end surface 13*a* of each of the contacts 13, and thus, the second contact point 13*g* side of the contact 13 is arranged and held in accordance with the wiring pattern 22 of the circuit board 21.

Even if the connection portion 86 in which the reception grooves 80 are formed is used, when deformation occurs in the circuit board 21, it becomes possible to prevent the soldered portion of the second contact point 13*g* of the contact 13 and the wiring pattern 22 of the circuit board 21 from being damaged.

Also in Embodiments 2 to 5, similarly to the above, the reception grooves 80 each of which has only the first groove portion 80*a* configured to receive the periphery of the first contact point 13*e*, 53*e*, or 63*e* of the contact 13, 53, or 63 may be employed.

Although the provisional contact fixing member 17, 37, 47, 57, or 67 in Embodiments 1 to 5 is made of an insulator, since the provisional contact fixing member 17, 37, 47, 57, or 67 is removed after the electrical connector 11, 31, 41, 51, or 61 is mounted on the circuit board 21, the provisional fixing contact member 17, 37, 47, 57, or 67 may be made of a conductor, such as metal materials.

In addition, in Embodiments 1 to 6, although the second contact point 13*g*, 53*g*, or 63*g* of each of the plurality of contacts 13, 53, or 63 is soldered to the corresponding wiring pattern 22 of the circuit board 21 (second connection object), and the first contact point 13*e*, 53*e*, or 63*e* is connected to the corresponding wiring pattern 24 of the connection object 23 (first connection object), such as an FPC and an FFC, the invention is not limited thereto. In contrast, a configuration in which the second contact point 13*g*, 53*g*, or 63*g* of the contact 13, 53, or 63 is soldered to the corresponding wiring pattern 24 of the connection object 23 (first connection object), and the first contact point 13*e*, 53*e*, or 63*e* is connected to the corresponding wiring pattern 22 of the circuit board 21 (second connection object) may be employed.

Further, the first connection object is not limited to the connection object 23, such as an FPC and an FFC, and similarly to the circuit board 21 which is the second connection object, a circuit board may be used as the first connection object. In this case, both circuit boards are connected together through the electrical connector according to the present invention.

The present invention can be applied to an electrical connector of a type in which connection to a connection object is performed without using the actuator 14.

What is claimed is:

1. An electrical connector which connects a first connection object and a second connection object each having a predetermined wiring pattern, the electrical connector comprising:

a plurality of contacts, each contact having a first contact point, which is electrically connected to the wiring pattern of the first connection object, at one end and a second contact point, which is to be mounted and fixed onto the wiring pattern of the second connection object by soldering, at the other end, wherein the plurality of contacts is arranged in accordance with the predetermined wiring pattern, and after the second contact point is mounted and fixed onto the wiring pattern of the second connection object, portions other than the second contact point of each of the contacts are not fixed and bound with respect to the second connection object, wherein the electrical connector further comprises:

a provisional contact fixing member which extends from one of at least a pair of mound portions to the other of the pair of mound portions and is configured such that both end portions thereof are detachably fixed to the pair of mound portions and the intermediate portion thereof provisionally fixes the plurality of contacts, wherein the provisional contact fixing member is removed after the second contact point of each of the plurality of contacts is mounted and fixed onto the wiring pattern of the second connection object, wherein the both end portions of the provisional contact fixing member and the pair of mound portions have fitting portions and fitted portions capable of being fitted to each other, the fitting portions and the fitted portions being fitted to each other such that the both end portions of the provisional contact fixing member are detachably fixed to the pair of mound portions, and wherein the intermediate portion of the provisional contact fixing member has a plurality of first provisional fixing portions which temporarily fixes second provisional fixing portions formed in the plurality of contacts, the second provisional fixing portions of the plurality of contacts being temporarily fixed to the plurality of first provisional fixing portions to provisionally fix the plurality of contacts.

2. The electrical connector according to claim 1, further comprising:

a base member which includes the pair of mound portions disposed in both end portions in the arrangement direction of the plurality of contacts.

3. The electrical connector according to claim 2, wherein the base member includes a connection portion which connects the pair of mound portions with each other and which has a plurality of reception grooves arranged corresponding to the plurality of contacts, each of the plurality of reception grooves is formed wider than the width in the arrangement direction of each of the plurality of contacts such that a predetermined clearance is formed between the reception groove and the contact received in the reception groove, and the plurality of contacts is arranged in a state of being inserted into the plurality of reception grooves.

4. The electrical connector according to claim 3, wherein each of the plurality of reception grooves has a first groove portion which receives the first contact point side of the contact such that a first clearance is formed between the reception groove and the corresponding contact, and a second groove portion which receives the second contact point side of the contact such that a second clearance greater than the first clearance is formed between the reception groove and the corresponding contact.

5. The electrical connector according to claim 3, wherein each of the plurality of reception grooves receives only the first contact point side of the corresponding contact.

6. The electrical connector according to claim 1, wherein the fitting portions are composed of projections which are respectively formed in the both end portions of the provisional contact fixing member, and the fitted portions are composed of projection insertion holes which are respectively formed in the pair of mound portions and into which the projections are inserted.

7. The electrical connector according to claim 1, wherein each of the second provisional fixing portions is composed of a protrusion formed on the second contact point side of the contact, and each of the first provisional fixing portions is composed of a protrusion insertion hole into which the protrusion of the contact is inserted.

8. The electrical connector according to claim 2, wherein each of the pair of mound portions of the base member has a fixing and reinforcing metal attachment which is to be fixed to the second connection object by soldering.

9. The electrical connector according to claim 1, wherein the first contact point of each of the plurality of contacts is a spring-contact.

10. The electrical connector according to claim 1, wherein at least one of the first connection object and the second connection object is a circuit board.

* * * * *